US006629913B2

(12) United States Patent
Chen

(10) Patent No.: US 6,629,913 B2
(45) Date of Patent: Oct. 7, 2003

(54) EXERCISE DEVICE

(75) Inventor: Shane Chen, Camas, WA (US)

(73) Assignee: CID, Inc., Camas, WA (US)

( * ) Notice: Subject to any disclaimer, the term of this patent is extended or adjusted under 35 U.S.C. 154(b) by 205 days.

(21) Appl. No.: 09/770,533

(22) Filed: Jan. 25, 2001

(65) Prior Publication Data

US 2001/0018385 A1 Aug. 30, 2001

(51) Int. Cl.[7] ..... A63B 21/00
(52) U.S. Cl. ..... 482/129; 482/132; 482/121
(58) Field of Search ..... 482/121–130, 482/99, 122, 123, 102, 103, 132, 127

(56) References Cited

U.S. PATENT DOCUMENTS

| | | | | |
|---|---|---|---|---|
| 2,821,394 A | | 1/1958 | Barbeau | |
| 3,584,871 A | | 6/1971 | Kelmon | |
| 3,664,667 A | | 5/1972 | McCarthy | |
| 3,752,475 A | | 8/1973 | Ott | |
| 4,171,805 A | | 10/1979 | Abbott | |
| 4,900,017 A | | 2/1990 | Bold, Jr. | |
| 5,261,866 A | | 11/1993 | Mattox | |
| 5,599,260 A | * | 2/1997 | Rovinsky | 482/121 |
| 5,632,707 A | | 5/1997 | Daniel et al. | |
| 5,643,162 A | | 7/1997 | Landers et al. | |
| 6,093,136 A | * | 7/2000 | Whipple | 482/123 |
| 6,203,476 B1 | | 3/2001 | Wang et al. | |
| 6,336,894 B1 | * | 1/2002 | Kestila | 482/99 |

* cited by examiner

*Primary Examiner*—Jerome Donnelly
(74) *Attorney, Agent, or Firm*—Chernoff, Vilhauer, McClung & Stenzel LLP

(57) ABSTRACT

An exercise device having an elongate, substantially rigid pad. The exercise device also includes a pair of handrollers, each handroller comprising a handgrip supported between a pair of wheels. The device also includes a pair of stretchable tensioning members. Each of the tensioning members interconnects a respective one of the pair of handrollers and the pad.

7 Claims, 6 Drawing Sheets

EXERCISE DEVICE

BACKGROUND OF THE INVENTION

The present invention relates to an exercise device, and in particular a wheeled exercise device.

There are numerous exercises which an individual may practice to strengthen muscles and maintain muscle tone. One kind of exercise device involves handrollers which are rolled across a floor. In some of these types of devices, the user supports his weight on the rollers while performing the exercise. Exemplary of these types of devices are Landers, et al., U.S. Pat. No. 5,643,162 and Abbott, U.S. Pat. No. 4,171,805. These particular exercise devices employ tracks for guiding the motion of the handrollers. Another type of exercise device is disclosed in Barbeau, U.S. Pat. No. 2,821,394, which discloses a handroller having an internal spring to provide resistance to rotation of the handroller. However, these types of devices are limited to particular types of exercises, particularly those involved with rolling the handrollers across a surface.

Another type of rolling exercise device comprises a wheel having a pair of handles on opposite sides of the wheel. Such devices are disclosed in Ott, U.S. Pat. No. 3,752,475 and Mattox, U.S. Pat. No. 5,261,866. These types of devices are limited to a particular kind of exercise, namely one involving rolling the wheel backwards and forwards while the user moves from a kneeling or crouched position to an extended position, and then returning to the kneeling or crouched position.

What is desired is an exercise device that allows a user to perform a variety of exercises, including exercises involving the use of a wheeled device capable of supporting the user's body, that also allows the user to perform other exercises, that is capable of providing various degrees of resistance to movement, that allows a user to isolate particular muscle groups, and which is easy to adjust to accommodate users of different sizes.

BRIEF SUMMARY OF THE INVENTION

The present invention overcomes the aforesaid drawbacks of the prior art by providing an exercise device that allows a user to perform a variety of exercises including those involving use of a handroller.

In one aspect of the invention, an exercise device has an elongate, substantially rigid pad. The exercise device also includes a pair of handrollers, each handroller comprising a handgrip supported between a pair of wheels. The device also includes a pair of stretchable tensioning members. Each of the tensioning members interconnects a respective one of the pair of handrollers and the pad.

In another aspect of the invention, an exercise device is provided having an elongate, substantially rigid pad. The device includes a pair of handrollers, each handroller comprising a handgrip supported between a pair of wheels. The device has a pair of stretchable tensioning members, each of the tensioning members interconnecting a respective one of the pair of handrollers in the pad. A fastening mechanism is operably connected to each tensioning member, the fastening mechanism comprised of a pair of wheels, each one of the pair of wheels being coupled to a respective biasing mechanism.

Yet another aspect of the invention provides a method for performing an exercise. An elongate substantially rigid pad is provided. In addition, a pair of handrollers is provided, each handroller comprising a handgrip supported between a pair of wheels. A pair of stretchable tensioning members is provided, and each of the tensioning members is interconnected with a respective one of the pair of handrollers and the pad. The handrollers are grasped, and at least one of the handrollers is moved away from the pad.

The invention provides several advantages over other wheeled exercise devices. The invention allows a user to engage in a variety of exercises. The user may perform those exercises involving the use of a handroller. However, the user may also perform a variety of other exercises by pushing or pulling the handroller away from the pad, without necessarily rolling the handroller along the floor. Because the invention provides a pair of handrollers, different muscles groups may be exercised at different times, allowing the user to isolate the desired muscle groups.

The foregoing and other objectives, features and advantages of the invention will be more readily understood upon consideration of the following detailed description of the invention, taken in conjunction with the accompanying drawings.

DETAILED DESCRIPTION OF THE PREFERRED EMBODIMENTS

Figure 1:
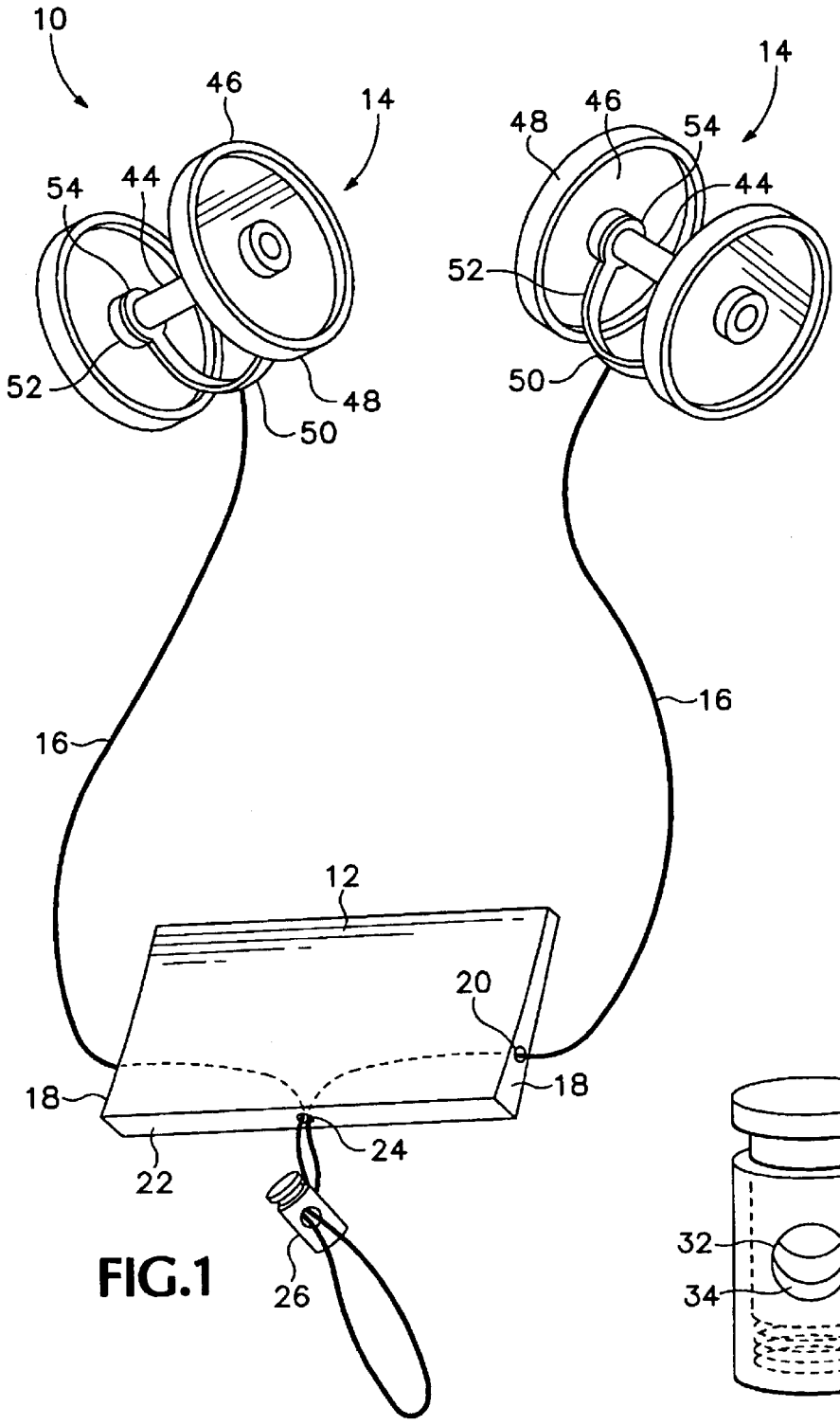
FIG. 1 shows a perspective view of an exemplary exercise device of the present invention.
Figure 1A:
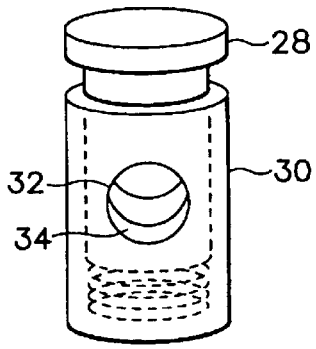
FIG. 1A is a perspective view of an exemplary fastening mechanism of the present invention.

Referring now to the figures, wherein like numbers refer to like elements, FIG. 1 shows an exercise device 10 having a pad 12, a pair of handrollers 14, and a pair of elastic tensioning members 16. Each tensioning member 16 interconnects one of the handrollers 14 with the pad 12. The tensioning member 16 provides resistance to movement of the handroller 14 away from the pad 12. Thus, exercises may be performed by moving the handroller 14 away from the pad 12 against the resistance provided by the tensioning member 16.

Figure 3A:
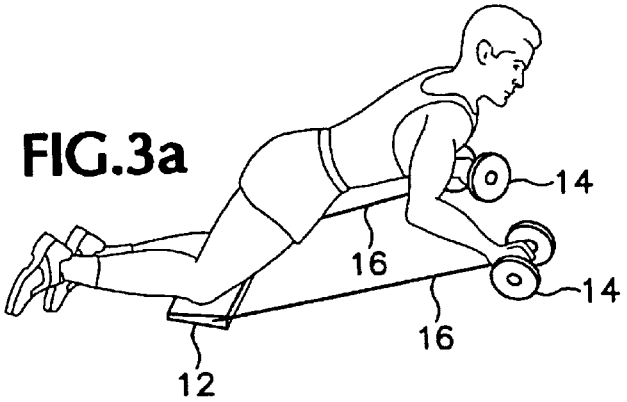
FIGS. 3A–3P illustrate a variety of exercises that may be performed with the exercise device of the present invention.
Figure 3B:
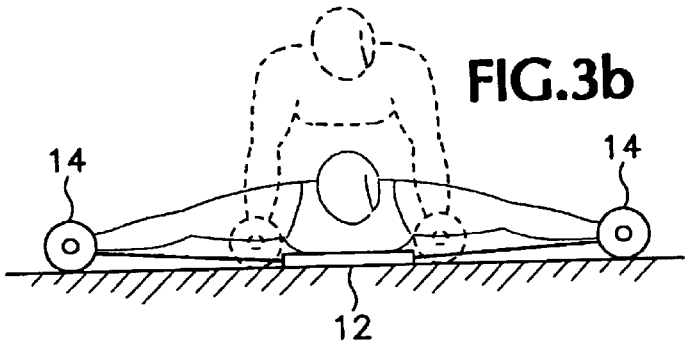
Figure 3C:
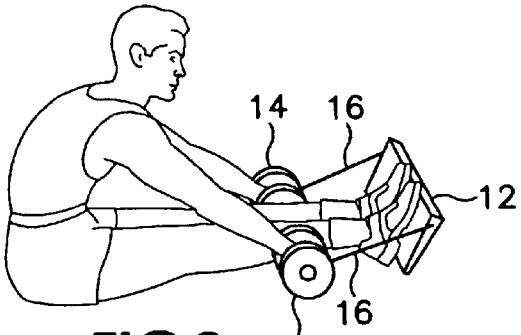
Figure 3D:
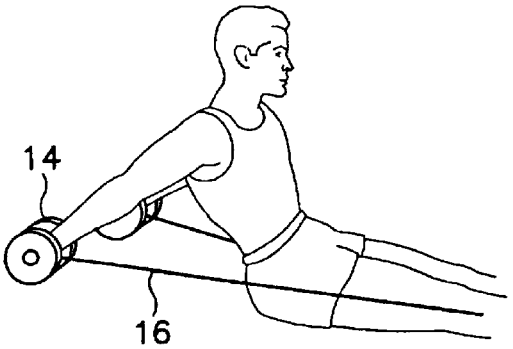
Figure 3E:
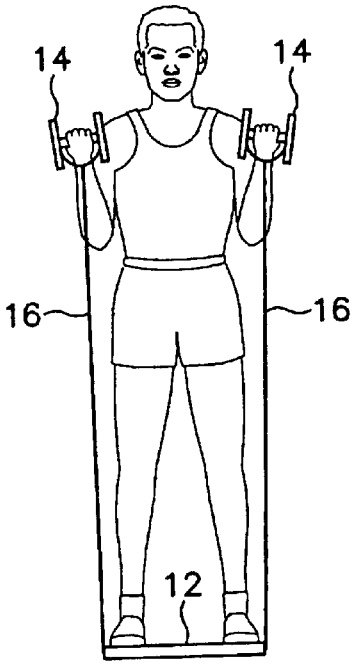
Figure 3F:
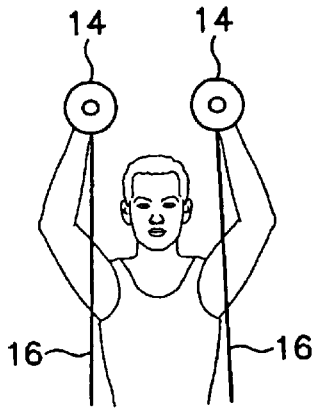
Figure 3G:
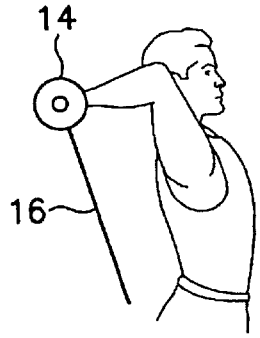
Figure 3H:
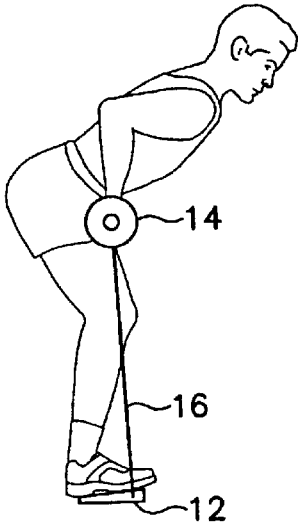
Figure 3I:
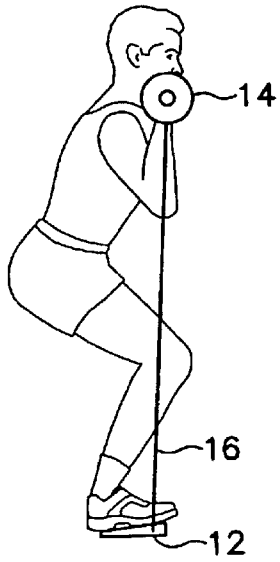
Figure 3J:
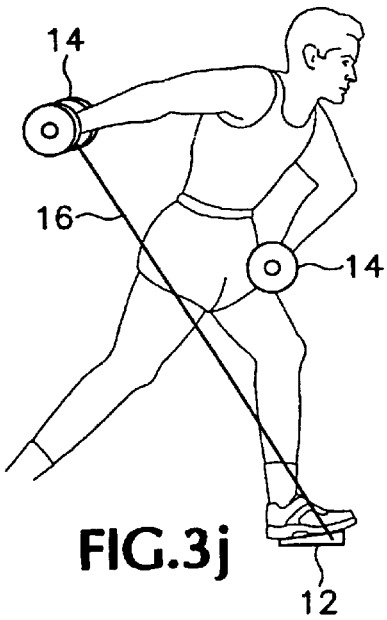

The pad 12 is substantially rigid, meaning that the pad 12 is capable of maintaining an approximately elongate shape even though loads are exerted at different ends of the pad 12 by the tensioning members 16. It is desired that the pad is capable of maintaining its shape and resisting movement while the handrollers are moved during the exercise. This allows the exercise device 10 to be used in a variety of exercises in which the user stands on or otherwise pushes against the pad 12. For example, as shown in FIGS. 3*c*, 3*h*, and 3*j*, a variety of exercises may be performed in which the user places his or her feet against the pad 12 and pulls or pushes the handrollers away from the pad. While the pad is desired to be substantially rigid, nevertheless it may flex or bend to some degree, so long as it is capable of continuing to resist movement during performance of the exercise. Preferably, the pad is sufficiently rigid to allow one foot of the user to be placed on the device while the exercise is performed, as illustrated in FIG. 3*j*. The pad may be made from any conventional material, such as plastic, stiff foam, metal, wood, or a combination thereof.

The exercise device provides a fastening mechanism for adjustably connecting the tensioning members 16 to the pad 12. Thus, the pad 12 may be provided with a plurality of fasteners or other devices which allow the tensioning member to be connected to the pad. One exemplary fastening mechanism for adjustably connecting the tensioning member to the pad 12 is illustrated in FIG. 1. The pad 12 has a pair of sidewalls 18, and each sidewall 18 defines an opening 20. The opening 20 is capable of receiving one of the tensioning members 16. The pad 12 also has a back wall 22 defining another opening 24. The tensioning members 16 pass through the back wall 22 and then are fastened with a fastener 26. The fastener 26 is a clamp type fastener having a pair of members 28 and 30 which are telescopically engaged, having aligned openings 32 and 34. A spring within the fastener 26 urges the member 28 away from the member 30. The tensioning members are inserted into the aligned openings 32 and 34 and the fastener 26, and the spring urges the member 28 to push against the tensioning members 16, thus securely fastening the tensioning members. The length and hence resistance provided by the tensioning members is adjusted by pulling the tensioning members 16 through the openings to the desired length and securing the fastener 26 to the tensioning members 16 at the desired location.

While a particular fastener 26 has been shown, other similar types of devices may be used as well, it being understood that the fastener need only securely clamp the two tensioning members together and be large enough so as to not pass through the opening 24.

Figure 2:
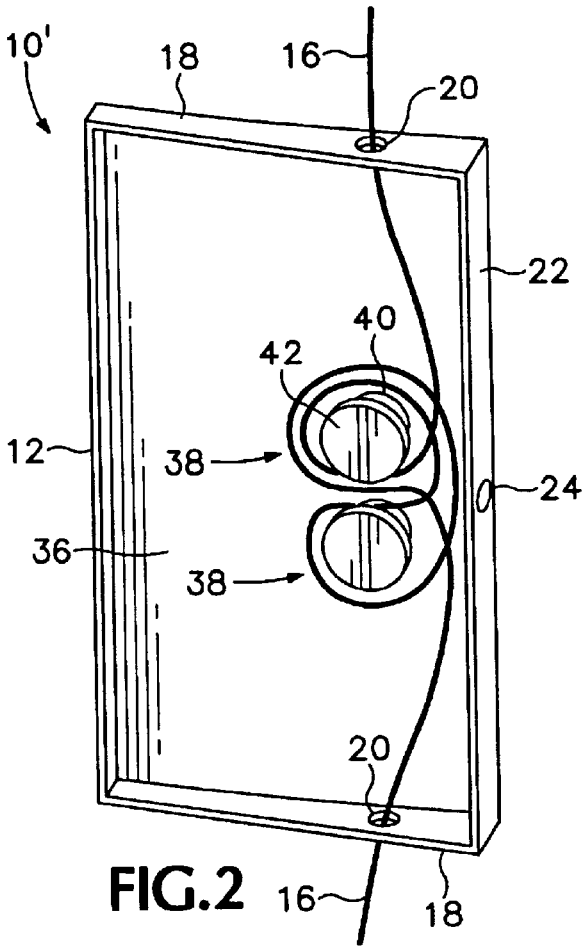
FIG. 2 is a perspective view of the underside of an alternative pad of the present invention.
Figure 2A:
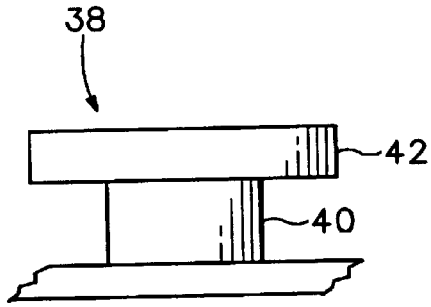
FIG. 2A is a side view of a fastening member of FIG. 2.

An alternative fastening mechanism is shown in FIG. 2. FIG. 2 shows the underside 36 of the pad 12 of another exercise device 10' of the present invention. A pair of fasteners 38 protrude from the pad, each fastener having a stem and rim 40. The tensioning members are inserted into the openings 24, and then wound around the fasteners 38 underneath the rim 40 until the desired length for the tensioning members 16 is achieved.

While a single fastening mechanism operably connected with both tensioning members has been shown, the exercise device may comprise a pair of fastening mechanisms, each operably connected with one tensioning member.

Figure 4:
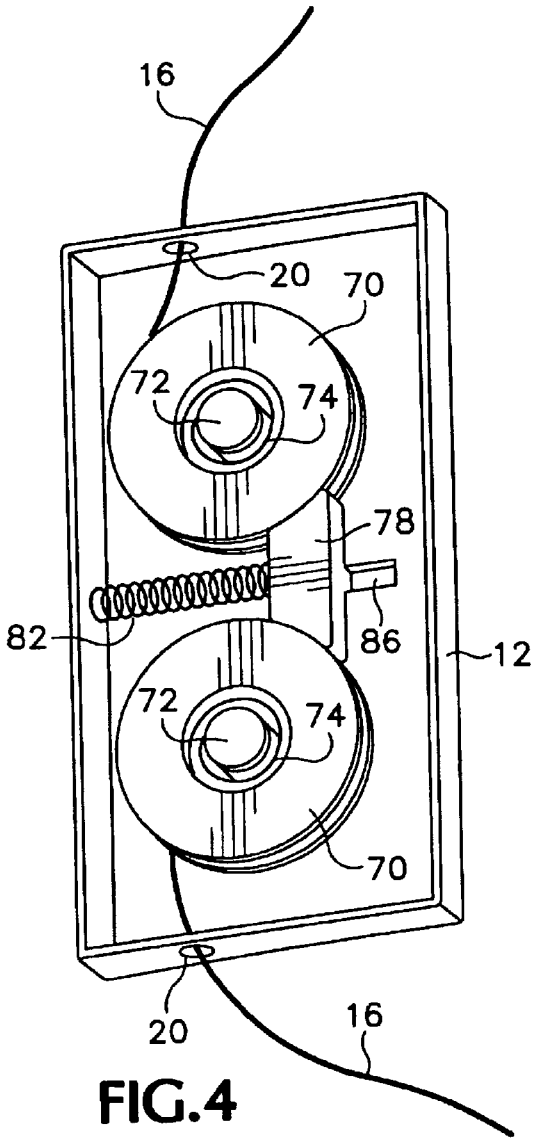
FIG. 4 shows the underside of yet another embodiment of the present invention having yet another alternative fastening mechanism.

FIG. 4 shows another exemplary exercise device 10" of the present invention, having yet another alternative fastening mechanism. Referring now to FIG. 4, located at the underside of the pad 12 are a pair of tensioning wheels 70, each rotatably mounted to a pair of posts 72. Each tensioning wheel 70 is mounted to the post by means of a spring coil 74. A tensioning member 16 is connected to each wheel 70. Each tensioning wheel has a pair of rims 76, and the rims 76 are spaced apart so as to receive the tensioning member 16 and such that the tensioning member 16 may be wound around the tensioning wheel 70 between the rims 76. The tensioning members 16 are wound in opposite directions around the tensioning wheels 70, so that the tensioning wheels 70 rotate in opposite directions when the tensioning members 16 are either pulled away from the wheels 70 (that is, unwound), or allowed to be taken up by the wheels 70 (that is, wound).

Figure 4A:
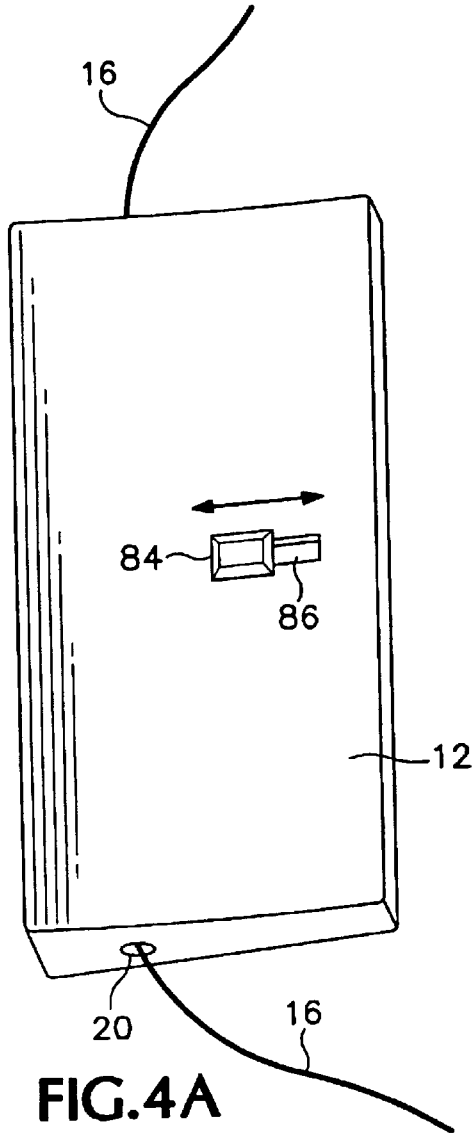
FIG. 4A shows the exercise device of FIG. 4 as seen in perspective view from the top.

A stopper 78 is interposed between the two wheels 70. The stopper 78 has two wheel engaging surfaces 80 for frictionally engaging the rims 76 of the wheels 70. A tension spring 82 urges the stopper 78 into frictional engagement with the tensioning wheels 70 to prevent rotational movement of the tensioning wheels 70. The stopper 78 has a slide member 84 which fits within a slot 86 in the pad 12. The slot 86 allows the stopper 78 to be moved into and out of engagement with the tensioning wheels 70. FIG. 4A shows the top of the pad 12, with the slide member 84 protruding through the slot 86. This allows the user to push the slide member so as to move the stopper into and out of engagement with the tensioning wheels 70 when the pad is resting on a surface, such as a floor. While a particular mechanism is shown that is capable of preventing the tensioning wheels 70 from rotating, other devices may be used, such as a rachet and pawl mechanism.

To use the fastening mechanism of FIG. 4, preferably a substantial portion of the tensioning member 16 is prewrapped around each tensioning wheel 70. To adjust the length of each tensioning member 16, the slide member 84 is pushed forward in the slot 86, so that the stopper 78 no longer engages the tensioning wheels 70. To lengthen the tensioning member 16, each tensioning member 16 is pulled so as to unwind the tensioning member from the respective tensioning wheel 70. Similarly, if it is desired to shorten the length of the tensioning member 16, the stopper 78 is disengaged, and the tension of each spring coil 74 causes each wheel to rotate so as to wind each tensioning member 16 around each respective wheel. This fastening mechanism has the advantage that the length and/or tension for each tensioning member 16 may be adjusted individually.

Alternatively, an adjustable fastening mechanism may be provided with the handroller allowing the length and/or tension of the tensioning members to be adjusted. For example, the tensioning members may be taken up inside the handgrip.

Figure 3K:
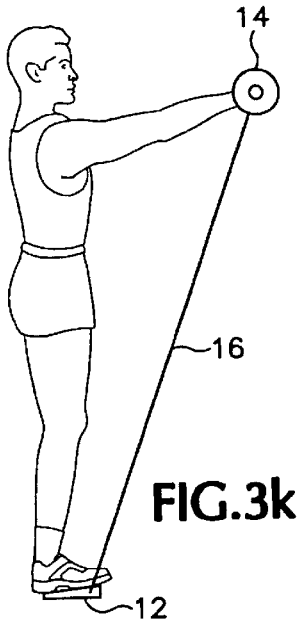
Figure 3L:
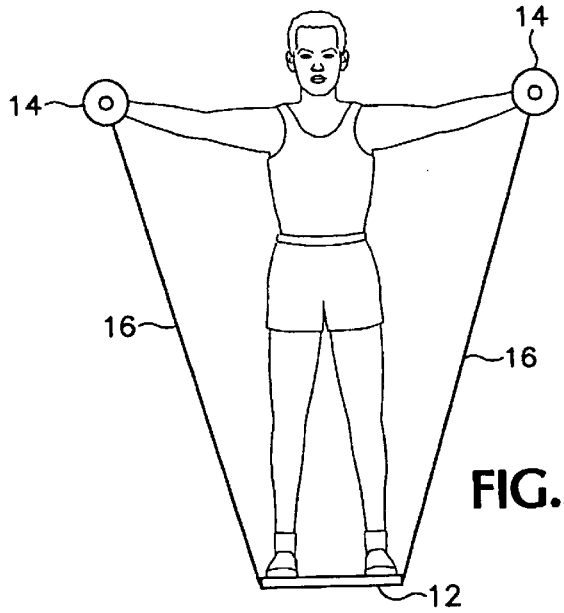

The exercise device provides a pair of handrollers. Providing a pair of handrollers provides several advantages. The handrollers may be moved away from each other during an exercise, such as in the exercises shown in FIGS. 3*b*, 3*d* and 3*m*. The handrollers may be moved in unison parallel to each other away from the pad, as illustrated in FIGS. 3*a*, 3*c*–3*d*, 3*o* and 3*p*. Alternatively, the handrollers may be moved individually, such as in the exercises shown in FIGS. 3*j* and 3*k*. A user can thus isolate specific muscle groups, such as those on one side of the body.

Returning now to FIG. 1, each handroller 14 is comprised of a handgrip 44 supported by a pair of wheels 46. The handgrip should be sufficiently rigid so as to support the weight of the user. Preferably, the handgrip is made of metal; however, the handgrip may be made of other strong materials, such as plastic that is sufficiently rigid. The handgrip may be textured, such as provided with grooves or ridges, so as to aid the grasping of the handroller. The wheels 46 should also be strong and durable, and may be formed of plastic, metal, or other strong rigid material. The wheels have an outer rim for engaging the surface of the floor. Preferably, the outer rim of the wheel is smooth and formed of a material that will not scratch or mar the surface on which it is used. The rim may be covered with a strip of rubber so as to provide a smooth, soft surface that will not damage the surface on which the handroller is used.

The handgrip and wheels are coupled to one another so as to allow rotational movement of the wheels with respect to the handgrip. Any conventional bushing or bearing may be used to couple the handgrip to the wheels. Preferably, the bearing allows smooth rolling of the wheels when the handgrips support the weight of the user. Accordingly, bearing systems such as ball bearings may be used.

Together, the handgrip and wheels must be sufficiently rigid and coupled together securely so as to support the weight of the user. It is desired that the exercise device be used in connection with several exercises in which the user supports his or her weight on the device, such as the exercises illustrated in FIGS. 3*a*, 3*b*, 3*o* and 3*p*.

The handrollers 14 also include means for fastening the tensioning member 16 to the handroller 12. For example, as shown in FIG. 1, the handroller includes a yoke 50. The yoke has a pair of ends 52, each end 52 defining an opening 54 for receiving the handgrip 44. This allows the yoke and handgrip 44 to move freely with respect to one another, so that the handgrip 44 may be rotated while the yoke 50 remains in a fixed relationship with respect to the tensioning member 16. The tensioning member 16 is connected to the yoke 50 near the center of the yoke. The two ends 52 of the yoke 50 are spaced far enough apart from one another so that the yoke 50 forms an arch. This allows the user to grasp the handgrip 44 through the arch without interference from the yoke.

The arrangement of the yoke as shown in FIG. 1 provides several advantages. First, the yoke allows the handgrip 44 to rotate freely with respect to the yoke 50. Therefore, the user may perform exercises that involve rotation of the handgrip 44, while the position of the yoke 50 is determined by the resistence provided by the tensioning member 16. The yoke 50 also distributes the resistence provided by the tensioning member 16 evenly across the handroller 12. Thus, the tensioning member 16 does not twist or otherwise impart torque on the handgrip 44 during movement in an exercise. The yoke also allows the user to perform a variety of exercises involving movement of the handrollers away from the pad. For example, the user may perform biceps curls, as illustrated in FIG. 3*e*.

The resistence to movement of the handrollers is provided by the pair of tensioning members 16, which interconnect the pad 12 with the handrollers 14. The tensioning members 16 are stretchable, and provide resistence to movement of the handrollers 14 away from the pad 12. The tensioning members 16 may be made of any conventional material that is capable of being stretched and providing resistence to movement. One preferred material is an elastomer, such as a rubber line or rubber tubing. Alternatively, a coil spring may be used. Where a coil spring is used, it is desired to enclose the coil spring in a flexible, and stretchable sheath which protects the user from being pinched by the spring.

The tensioning members 16 may be separate or connected to one another. For example, as shown in FIG. 1, the pair of tensioning members 16 are separate portions of a single elastomeric piece of tubing.

Preferably, the length of the tensioning members is adjustable so that the exercise device may be adjusted to fit users of different sizes, and/or to provide different degrees of resistence to movement of the handrollers. As described above, various fastening mechanisms may be used to adjust the length of the tensioning members.

Figure 3M:
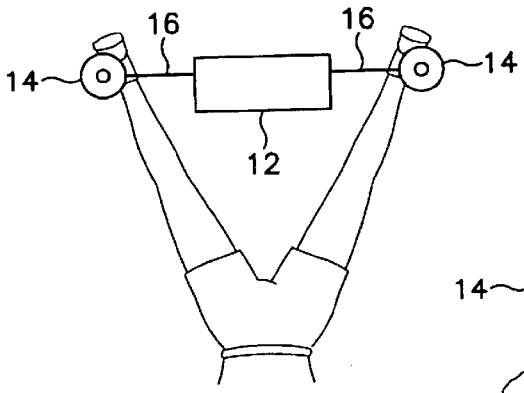
Figure 3N:
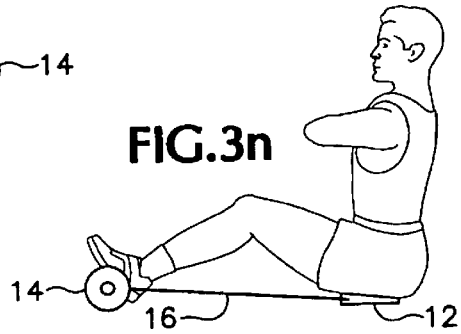
Figure 3O:
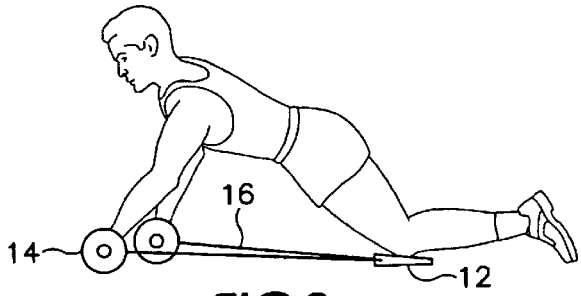
Figure 3P:
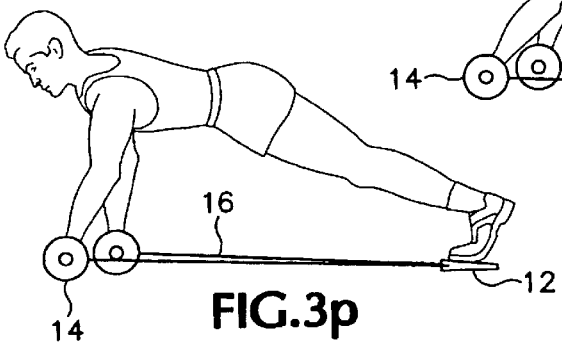

The exercise device is used by moving the handrollers away from and back toward the pad. FIGS. 3*a*–3*p* illustrate a variety of exercises that may be performed. To perform an exercise, the user first adjusts the length of the tensioning members 16 so as to provide the desired degree of resistence to movement of the handrollers. Next, the user places the pad 12 in a position with respect to the user's body so as to prevent the pad from moving. For example, the user may place his knees on the pad, as shown in FIG. 3*a*, his or her feet on the pad as shown in FIGS. 3*h* and 3*j*, or his or her buttocks on the pad as shown in FIG. 3*n*. Alternatively, the user may be seated and place the pad in front of his or her feet as shown in FIG. 3*c*, or may place the pad directly underneath the user's torso as shown in FIG. 3*b*.

The user then moves the handrollers 14 away from the pad 12. The exercise requires the user to overcome the resistence provided by the tensioning members 16. The user may either roll the handrollers 12 along the floor, for example as shown in FIGS. 3*a*–3*d*, or may pull or push the handrollers away from the pad 12 when in an upright position, such as shown in FIGS. 3*e*–3*l*. The user may also push the handrollers 12 away from the pad 12 by using his or her feet, such as illustrated in FIGS. 3*n* and 3*m*. In this fashion, the user may exercise many different muscle groups, including those of the arms, chest, torso, back, and legs.

The present invention thus provides significant advantages over other wheeled exercise devices. The exercise device 10 allows many different exercises to be performed. The user may perform many conventional type of exercises often performed with free weights, such as the exercises illustrated in FIGS. 3*e*–3*l*. The user may also perform those exercises which require a wheeled exercise device, such as those illustrated in FIGS. 3*a*–3*d*. The exercise device is easily adjustable, allowing the user to quickly and easily change the resistance provided by the tensioning member. The exercise device allows the user to isolate muscle groups, such as by using one handroller at a time.

The terms and expressions that have been employed in the foregoing specification are used as terms of description and not of limitation, and there is no intention, in the use of such terms and expressions, of excluding equivalents of the features shown and described or portions thereof, it being recognized that the scope of the invention is defined and limited only by the claims that follow.

What is claimed is:

1. An exercise device, comprising:

(a) an elongate, substantially rigid pad;

(b) a pair of handrollers, each of said pair of handrollers comprising a handgrip supported between a pair of wheels;

(c) two stretchable tensioning members, each of said tensioning members interconnecting a respective one of said pair of handrollers and said pad; and (d) wherein said pad comprises a housing containing a plurality of fasteners, each fastener in said plurality having a stem and a rim wherein each of said tensioning members is wound about at least a respective one of said stems so as to regulate the length of each said tensioning member.

2. The exercise device of claim 1 wherein each of said pair of handrollers further comprises a yoke for attaching said tensioning member to said handroller.

3. The exercise device of claim 1 wherein said tensioning members are part of a single elastomer.

4. The exercise device of claim 1 wherein said pad has a pair of openings, each of said pair of openings receiving a respective one of said tensioning members.

5. An exercise device, comprising:

(a) an elongate, substantially rigid pad;

(b) a pair of handrollers, each handroller comprising a handgrip supported between a pair of wheels;

(c) a pair of stretchable tensioning members, each of said tensioning members interconnecting a respective one of said pair of handrollers and said pad; and (d) a fastening mechanism operably connected to each tensioning member, said fastening mechanism comprised of a pair of tensioning wheels, each one of said pair of tensioning wheels being coupled to a respective biasing mechanism.

6. The exercise device of claim 5 wherein each said respective biasing mechanism is coupled to a respective one of said pair of tensioning wheels so as to urge said pair of tensioning wheels to rotate in opposite directions.

7. The exercise device of claim 5, further comprising a stopper to resist rotation of said pair of tensioning wheels.

* * * * *